US005487332A

United States Patent [19]

Handke

[11] Patent Number: 5,487,332

[45] Date of Patent: Jan. 30, 1996

[54] PLATEN PRESS FOR WOODWORKING

[75] Inventor: Gerald Handke, Pfalzgrafenweiler, Germany

[73] Assignee: Gottfried Joos Maschinenfabrik GmbH & Co., Pfalzgrafenweiler, Germany

[21] Appl. No.: 236,640

[22] Filed: May 2, 1994

[30] Foreign Application Priority Data

May 19, 1993 [DE] Germany ..... 9307632 U

[51] Int. Cl.[6] ..... B30B 15/34

[52] U.S. Cl. ..... 100/93 P; 100/226; 100/269.03

[58] Field of Search ..... 100/93 P, 226, 100/269 A, 269.02, 269.03

[56] References Cited

U.S. PATENT DOCUMENTS

| | | | |
|---|---|---|---|
| 2,363,779 | 11/1944 | Duffy et al. | 100/269 A |
| 2,411,043 | 11/1946 | Klassen | 100/269 A |
| 2,735,461 | 2/1956 | Pater | 100/93 P |
| 3,213,739 | 10/1965 | Zingone | 83/563 |
| 3,318,232 | 5/1967 | Bartron et al. | 100/93 P |
| 3,667,891 | 6/1972 | Gelin | 100/269 A |
| 3,771,438 | 11/1973 | Radakovich | 100/269 A |
| 4,190,484 | 2/1980 | Pohl | 100/269 A |
| 4,429,629 | 2/1984 | Leonard | 100/226 |
| 4,816,103 | 3/1989 | Ernest | 100/269 A |

FOREIGN PATENT DOCUMENTS

| | | | |
|---|---|---|---|
| 385457 | 4/1988 | Austria . | |
| 0141801 | 2/1987 | European Pat. Off. . | |
| 0176498 | 11/1987 | European Pat. Off. . | |
| 144522 | 10/1980 | German Dem. Rep. | 100/93 P |
| 14892 | 8/1881 | Germany . | |
| 6604075 | 12/1969 | Germany . | |
| 2920926 | 11/1980 | Germany . | |
| 273477 | 5/1951 | Switzerland . | |
| 449933 | 4/1968 | Switzerland . | |
| 887160 | 12/1981 | U.S.S.R. . | |
| 82/02509 | 8/1982 | WIPO . | |

*Primary Examiner*—Stephen F. Gerrity
*Attorney, Agent, or Firm*—W. Thad Adams, III

[57] ABSTRACT

A press (11), more particularly usable as a platen press for woodworking, produces the pressing pressure by two superimposed rows (20,21) of hoses (19), which are filled with compressed air. An intermediate plate (17) ensures a pressure compensation. The pressing surfaces are formed by heating plates (29), the lower plate being partly extractable over the press frame, so as to facilitate loading and cleaning.

11 Claims, 3 Drawing Sheets

PLATEN PRESS FOR WOODWORKING

FIELDS OF USE AND PRIOR ART

The invention relates to a press, particularly a platen press for woodworking or the working of similar materials. The press is e.g. designed for the gluing of board-like materials under heat and pressure, particularly for producing veneered or plastic-coated boards. EP 141,801 B1 and EP 176,498 B1 disclose platen presses, in which the pressing force is applied by pneumatically inflatable hoses. Such platen presses have a relatively low mechanical expenditure and are therefore particularly suitable for repair organizations and the like.

PROBLEM AND SOLUTION

The problem of the invention is to further develop platen presses of the aforementioned type and in particular broaden their field of use, so that they are more universally usable. According to the invention this problem is solved in that in the case of a press with press drive by pneumatically inflatable hoses at least two rows of hoses are superimposed, This makes it possible to obtain a large stroke without the hoses having an excessive diameter. This saves compressed air, because e.g. two superimposed hoses with half the diameter require a much smaller overall air volume than one hose with twice the diameter. In addition, the large hoses would have to have a considerable spacing from one another, so that the pressure plate positioned above them would be exposed to higher stresses.

Between two rows of hoses can be provided a vertically movable, rigid intermediate plate, which has a mechanical compensating action and therefore helps to bring about a uniform application of the pressing force.

The press can have a rigid press frame with a reinforced upper and lower support plate. As a result of the large stroke it is possible to cover, without any setting means, i.e. with rigid support plates, a relatively large area of the worked board thicknesses. Therefore the press has a simple construction, because the upper and lower plates can be simple, rigid structures, e.g. assembled from double flanged beams.

The upper support plate can carry on its underside, like the top of the upper hose row, in each case a heating plate forming the pressing surface.

The heating plates can have a plate-like base body with electric heating conductors inserted in grooves and which are covered by a cover sheet and below which is positioned a high pressure insulating plate. This permits the electrical heating of the support plates for carrying out hot working operations or heat-requiring pressing processes.

The hoses of the hose rows can in each case be vertically superimposed, so that scarcely no bending forces are applied to the intermediate plates and the flux of force is directly introduced from the pressing surface into the lower support plate. If even greater strokes are required, use can be made of more than two hose rows. Although a horizontal arrangement (bottom ram press) with a movable pressing surface at the bottom is preferred, it is also possible to have other arrangements with several hose planes. Use should be made in the superimposed rows of separated hoses.

The hoses are preferably positioned in the longitudinal direction of the press. This makes it necessary to only have a smaller number of hoses and ensures a compact occupancy.

The hoses can be reciprocately displaced by their ends and in particular their end pneumatic connections in the hose longitudinal direction. Thus, despite thickening at the ends and in particular the connections, the hoses can be placed in a very confined space and with only a limited intermediate plate thickness, because then the end connections are staggered. Thus it is advantageously possible to have the hoses of the two hose rows of the same length.

It is particularly advantageous if the hoses of the two hose rows are supplied with compressed air from different sides, i.e. their end connections are in each case located at opposite hose ends. This not only ensures that there is a better positioning of the hose connections which may take up space, but also a more uniform action is obtained during the pressing process and in particular at the start thereof. Although naturally the pneumatic pressure in each hose is uniform at all points, as a result of different influences, e.g. the inflation characteristics of the hoses, certain restoring forces in the hose material, etc., the hose normally starts to inflate at the blowing in side and only then does the pressure pass over the entire hose length. As a result of the opposite arrangement of the blowing sides the pressing plate remains horizontal, without any further measures being necessary for this. A similar action can be obtained if adjacent hoses in the same row are connected to different ends, although then under certain circumstances the intermediate plate is subject to a less uniform action.

These and further features and constructions of the invention can be gathered from the claims, description and drawings, the individual features being realized, either singly or in the form of subcombinations, in an embodiment of the invention and in other fields and can represent advantageous, independently patentable constructions for which protection is hereby claimed. An embodiment of the invention is described in greater detail hereinafter relative to the attached drawings.

DESCRIPTION OF THE EMBODIMENT

Figure 1:
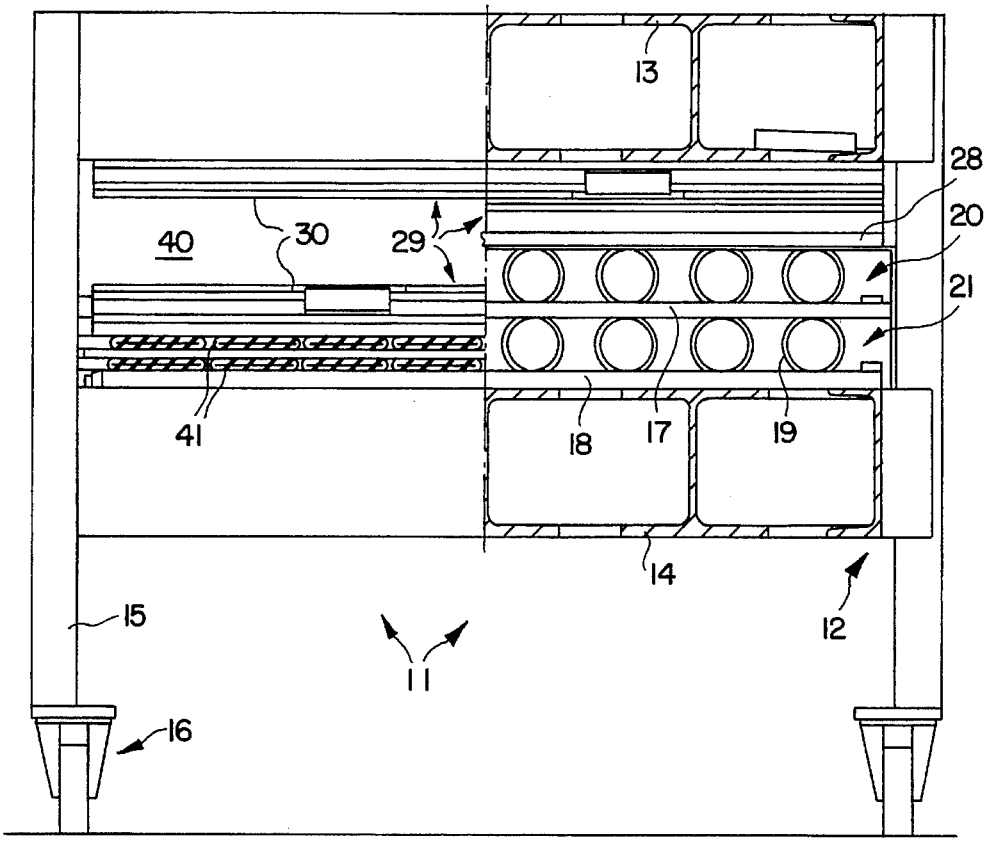
FIG. 1 is a part sectional front view of a press.

The drawings show a press 11 from the end 42. The right-hand side is on the one hand cut away and on the other shown in the closed state, whereas the left-hand side shows the plate in the open state.

A press frame 12 has an upper and a lower support plate 13,14, which are in each case assembled from wide-flanged double T-beams running in the longitudinal direction of the plate and in this way form a stiffened structure with individual longitudinal chambers. Thus, said support plates are designed in such a way that they maintain their planeness even under the highest attainable pressing pressures.

At their four corners the longitudinal rectangular support plates 13,14 are interconnected by vertical supports 15, which at the underside project over the lower plate 14 where there are rollers 16, so that the press can easily be moved.

Figure 2:
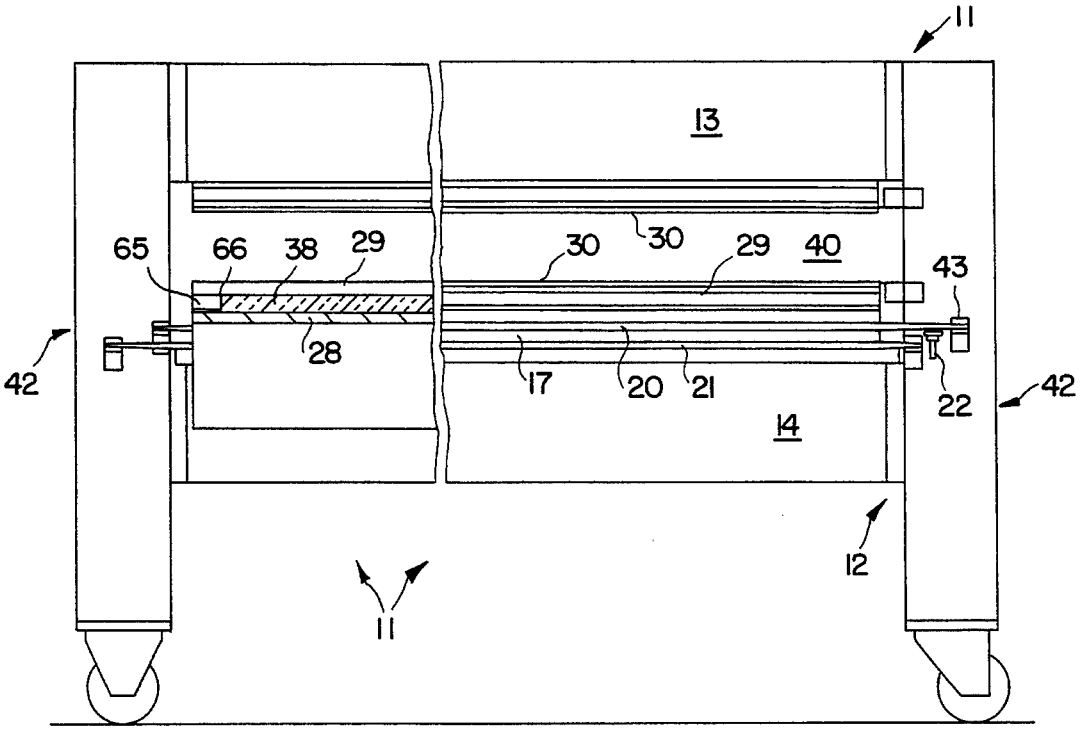
FIG. 2 is a shortened side view of the platen press.
Figure 6:
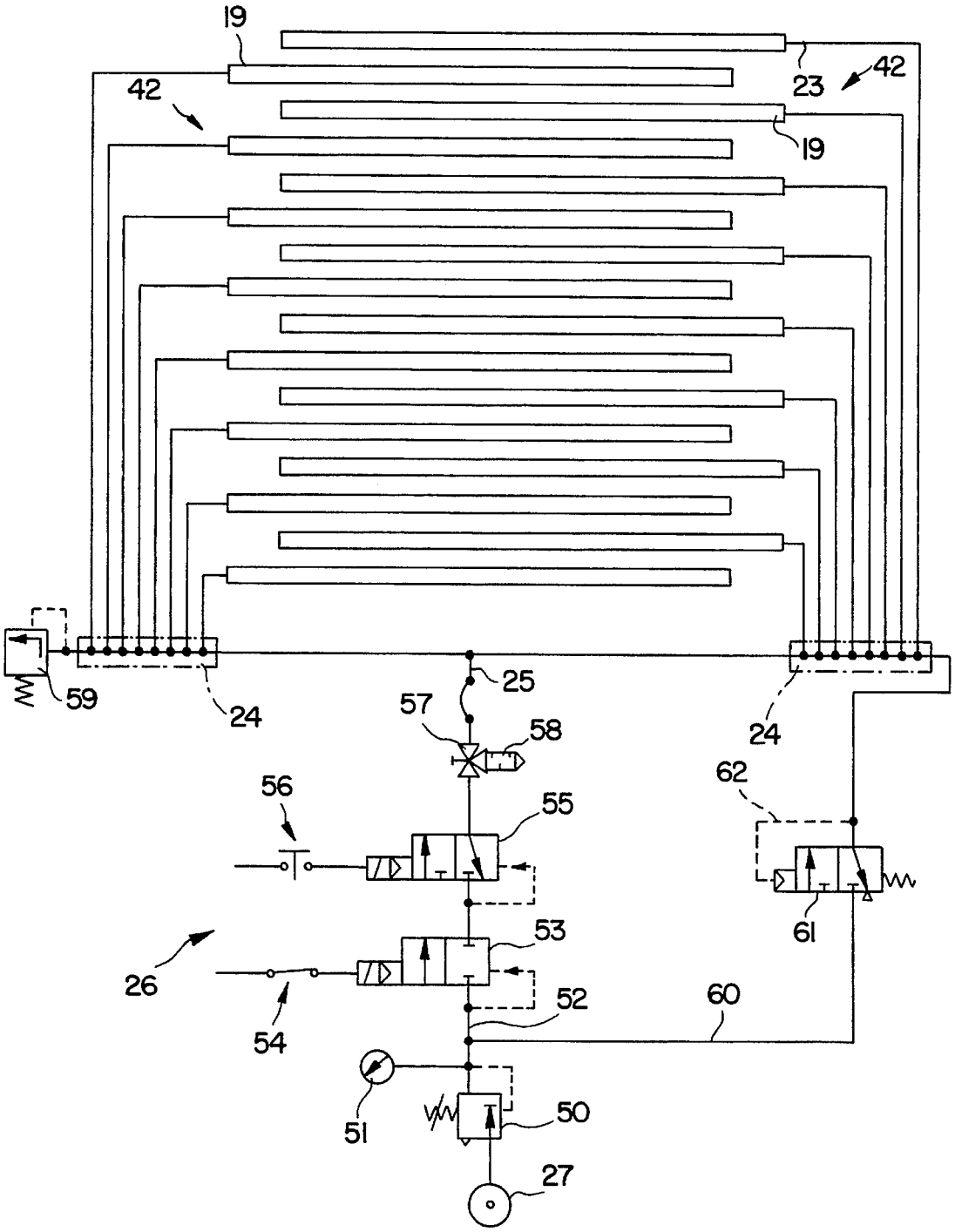
FIG. 6 is a diagrammatic arrangement and circuit diagram of the pneumatic connections of the press hoses.

On the lower support plate 14, below which there are intermediate plates 17,18, are provided two hose rows 20,21. They are in the form of hoses 19 made from a flexible material, e.g. rubber or plastic, optionally with fabric or similar inserts and extend over the entire press length (cf. FIG. 2). The hoses of the two hose rows are of the same length but, as can be seen in FIG. 2, are so reciprocally displaced, that their ends 22 and/or optionally connections 23 are displaced relative to one another. Each hose has a pneumatic connection 23, which is supplied by one or more distributors 24 (two distributors in FIG. 6) and a common compressed air connection 25. Upstream of the latter there is a single, not shown pneumatic circuit 26, which is supplied by a conventional compressed air network 27 or a compressor.

The pneumatic circuit 26 (FIG. 6) contains a pressure regulator 50 on which the desired pressing pressure can be set. This pressure can be read off by means of a pressure gauge 51. A safety solenoid valve 53 introduced into the pneumatic line 52 ensures that the press can only be closed by pressure action if a switch 54 is closed, which forms part of a contact protection system, e.g. through a safety line running round the press. In conjunction with the switch 54 it ensures that the press cannot be closed, when an operator has a hand in the press.

By means of a valve 55 and a probe 56 the release pulse for closing the press is provided. The relieving of the pressure for opening the press takes place by means of a three-way ball cock 57 having a large outlet cross-section, which optionally via a sound absorber 58 releases the compressed air out of the hoses. The pneumatic system is secured against an overpressure by a safety valve 59.

In a pneumatic line 60 located behind the pressure regulator but branching off upstream of the safety valve 53 is provided a pressure takeover valve 61. The latter is a valve which is operated exclusively pneumatically and not electrically and which has a control back-coupling 62 in the press direction. It can be set in such a way that it opens on dropping below a set pressure and compensates any pressure losses in the system.

FIG. 1 shows that the hoses of both rows are arranged parallel to one another and are in each case superimposed. Their spacing must at least be so large that the hoses can be juxtaposed on the intermediate plates 17,18 in the flat, i.e. unfilled state.

A heating plate 29 is placed on an upper plate 28, which covers the upper hose row and is vertically movable together therewith. A corresponding heating plate 29 is also located on the underside of the upper support plate 13. Their heating surfaces directed towards one another in each case form the upper and lower pressing surfaces 30.

Figure 3:
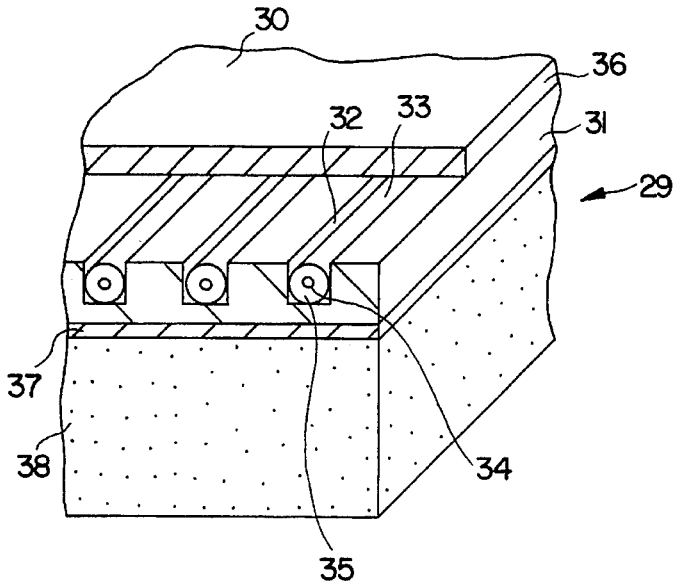
FIG. 3 is a perspective sectional view of a detail of a heating plate.

The structure of the heating plates 29 can be seen in FIG. 3. The basic body 31 of the heating plate is plate-like and is provided on the top with grooves 32 for receiving heating conductors 33 and is made from aluminium. The heating conductors 33 contain electrical heating resistors 34, which are surrounded by an electrical insulation 35, e.g. through a multiple spinning over of glass silk and a braiding with a protective film of polytetrafluoroethylene (PTFE). The grooves 32 are covered by a cover plate 36 fitted by adhesion to the basic body 31 and which is in the form of a metal sheet made from a good heat conducting alloy.

Below the basic body 31 is placed an insulating layer 37 of high pressure-compressed mineral fibres and below which is placed a high pressure insulating plate 38 made from highly compressed fibrous material (chipboard or the like), optionally with a phenolic resin. bond. Towards the pressing surface 30 said heating plate has very good heat transfer characteristics, whereas the back is provided with an effective insulation able to withstand the high pressing pressures.

Figure 4:
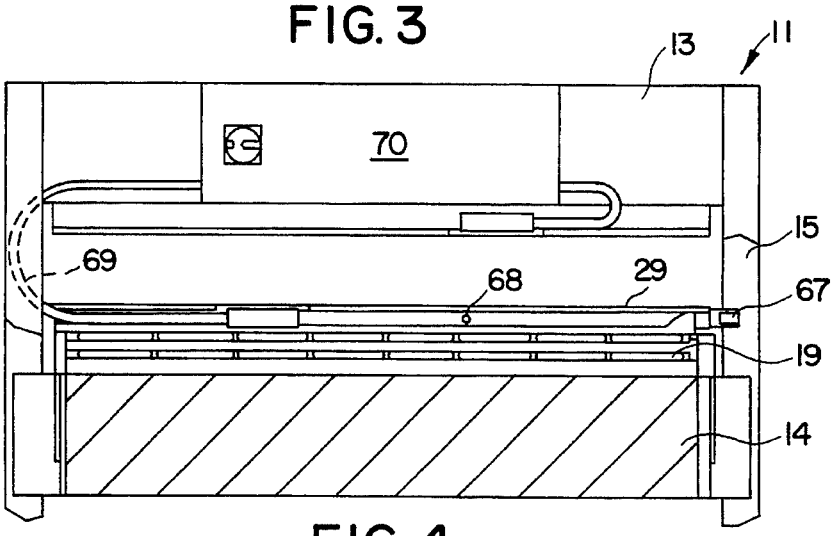
FIGS. 4 and 5 are views corresponding to FIG. 1 in two working positions.
Figure 5:
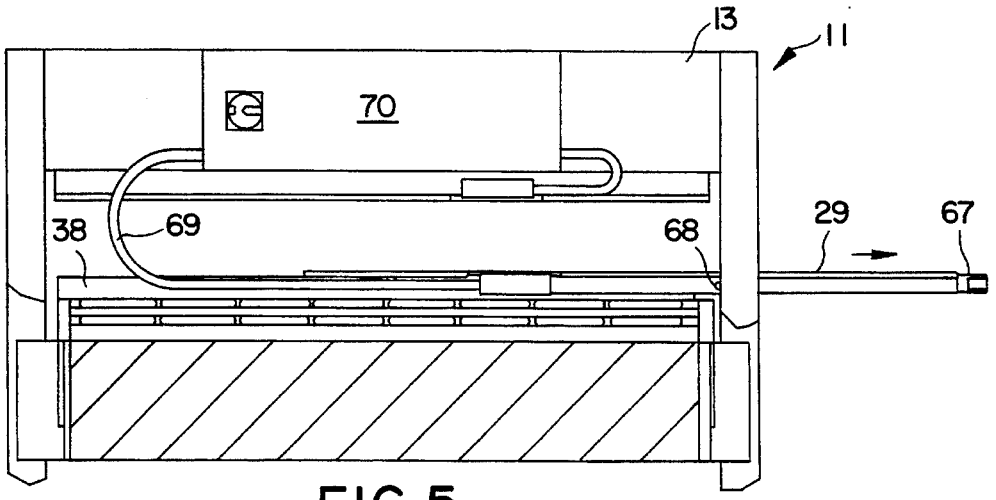

It can be gathered from FIGS. 2,4 and 5 that the lower heating plate is displaceably guided with respect to its substructure. For this purpose the heating plate 29 has on its two outer longitudinal sides guide strips or ledges 65, which run along the outer edges 66 of the insulating plate 38. The latter is firmly connected to the plate 28 covering the hoses 19 in the upwards direction, whereas the heating plate 29 only rests thereon in pressure-transferring manner.

By means of a handle 67 (FIGS. 4 and 5), the heating plate sliding on the insulating plate 38 can be extracted by roughly half from the press frame until a stop 68 prevents the further movement and therefore prevents a tilting of the heating plate 29. With a corresponding engaging guide a further extraction could also be allowed.

It can also be seen that the electrical connection of the lower heating plate takes place by means of a flexible cable 69 from a connecting device 70, so that the heating plate movement is made possible. The heating plate can be partly extracted from the press for lighter loading and/or for cleaning.

The heating conductors are provided with a heating control, which is not shown in detail and which can also contain heating regulating elements.

FUNCTION

The press functions in the following way. When the press is open (to the left in FIG. 1) the lower pressing surface 30 is charged with the material to be pressed, the press gap 40 being large and permitting easy charging. Charging is further facilitated by the extractability of the heating plate 29 (FIG. 5). The hoses 19 in the hose rows 20,21 are pressureless and empty, so that they form two flat layers 41.

Following charging compressed air is introduced into the hoses 19, namely in the two layers thereof from two different faces 42 of the press (FIGS. 2 and 3) via the pneumatic circuit 26 and the distributors 24, together with the pneumatic connections 23. For this purpose the pressure regulator 50 is set to the desired pressing pressure and the probe 56 is operated, so that the valve 55 opens. The safety valve 53 stops the pressure build-up when closed through the opening of the safety switch. The hoses are filled and thereby raise the intermediate plates 17,28, as well as the heating plate 29 fixed thereto, as well as the workpiece placed thereon and finally press it onto the underside of the upper heating plate 29, so that both plates can be heated.

As a result of the uniform action over the entire pressing surface with the pressure emanating from the hoses a very uniform pressing action is obtained without excessive mechanical expenditure being involved. It is merely necessary to ensure that the intermediate plates 17,28, as well as the lower heating plate 29 can move vertically. As a result of the arrangement of e.g. eight hoses per hose row with a freely inflatable diameter of e.g. 80 mm and which are at a reciprocal spacing of approximately 130 mm and in parallel manner over the entire press length of e.g. 2.5 m, a press stroke of approximately 120 mm can be ensured. The hoses are fixed at their ends between guide strips 43, which also ensure the necessary spacing of the hoses.

The circular, flexible hoses consequently engage in flat manner on the plates 17,18,28 and therefore transfer the pressing pressure in a well distributed manner. Since, after releasing the probe 26, the valve 55 has closed again, the pressure takeover valve 61 ensures that there is no drop below the pressure there or set on the pressure regulator 50, if a pressure loss occurs due to leaks.

Following the working time the air is released from the hoses 19 by means of the ball cock 57 and by reducing the pressure on the regulator 50, so that the lower pressing surface drops and the workpiece can be removed.

What is claimed is:

1. A platen press, comprising:

(a) at least one vertically movable press plate;

(b) a press drive for moving said press plate, and comprising at least two overlying rows of laterally disposed, pneumatically inflatable hoses, the hoses of each row residing adjacent to each other; and (c) at least one vertically movable, rigid intermediate plate interposed between the at least two hose rows, and extending over the full width of the hose rows in a direction transverse to the hoses.

2. A press according to claim 1, further comprising a rigid press frame including reinforced, upper and lower support plates supporting the movable press plate and intermediate plate therebetween.

3. A press according to claim 2, wherein said press plate includes a heating plate carried by an upper one of said at least two hose rows, and defining a pressing surface thereon for supporting a workpiece to be pressed.

4. A press according to claim 3, wherein said heating plate comprises a top cover plate, a bottom high-pressure insulating plate, and a base body located therebetween, said base body including a plurality of surface grooves formed therein and respective heating conductors positioned within the grooves.

5. A press according to claim 1, wherein the hoses of said first and second rows reside in overlying, vertical registration.

6. A press according to claim 1, wherein the hoses of said first and second rows of hoses are arranged in a longitudinal direction to the press.

7. A press according to claim 1, wherein the hoses of said first and second rows of hoses are of equal length.

8. A platen press, comprising:

(a) at least one movable press plate;

(b) a press drive for moving said press plate, and comprising at least two overlying rows of laterally disposed, pneumatically inflatable hoses, the hoses of each row being alternately laterally-displaced in a lengthwise direction, and having respective end pneumatic connections located at one end thereof;

(c) the end connections being located at opposite ends of adjacent hoses of one of said at least two hose rows, and at opposite ends of adjacent hoses of a second, overlying one of said at least two hose rows; and (d) the end connections of overlying hoses of the first and second hose rows residing at opposite ends of the overlying hoses.

9. A platen press, comprising:

(a) at least one movable press plate;

(b) a press drive for moving said press plate, and comprising at least one row of laterally disposed, pneumatically inflatable hoses, the hoses being alternately laterally-displaced in a lengthwise direction and having respective end pneumatic connections located at one end thereof; and (c) the end connections being located at opposite ends of adjacent hoses of the at least one hose row.

10. A platen press, comprising:

(a) at least one movable press plate supported by a press frame, said press plate including an insulating plate and a heating plate carried by the insulating plate, the heating plate being horizontally slidable relative to the insulating plate for movement between a press position, in which the heating plate resides substantially within the press frame, and a displaced position, in which the heating plate partially projects beyond the press frame; and (b) a press drive comprising at least one row of laterally disposed, pneumatically inflatable hoses for moving said press plate.

11. A platen press, comprising:

(a) at least one movable press plate;

(b) a press drive for moving said press plate, and comprising at least two overlying rows of laterally disposed, pneumatically inflatable hoses, and a pressure takeover valve for maintaining pressure in the hoses above a predetermined value following pressure build-up in the hoses.

* * * * *